United States Patent [19]

DeMoore et al.

[11] Patent Number: 5,042,384

[45] Date of Patent: Aug. 27, 1991

[54] ANTI-MARKING METHOD AND APPARATUS FOR USE WITH PERFECTOR CYLINDERS OF ROTARY SHEET-FED PRINTING PRESSES

[75] Inventors: Howard W. DeMoore, 10954 Shady Trail, Dallas, Tex. 75220; Howard C. Secor, Coppell, Tex.

[73] Assignee: Howard W. DeMoore, Dallas, Tex.

[21] Appl. No.: 516,523

[22] Filed: Apr. 30, 1990

[51] Int. Cl.[5] ..... B41L 15/10; B41F 5/00

[52] U.S. Cl. ..... 101/483; 101/416.1; 101/230

[58] Field of Search ..... 101/416.1, 420, 230, 101/231, 229, 220, 222, 223, 415.1, 419, 422, 483

[56] References Cited

U.S. PATENT DOCUMENTS

| | | | |
|---|---|---|---|
| 2,085,845 | 7/1937 | Binkley | 101/420 |
| 3,261,288 | 7/1966 | Dickerson | 101/420 |
| 4,395,949 | 8/1983 | Jeschke | 101/420 |
| 4,402,267 | 9/1983 | DeMoore | 101/419 |
| 4,691,632 | 9/1987 | DeMoore | 101/419 |
| 4,694,750 | 9/1987 | Greene | 101/420 |

*Primary Examiner*—Edgar S. Burr
*Assistant Examiner*—C. A. Bennett
*Attorney, Agent, or Firm*—Kelly, Bauersfeld & Lowry

[57] ABSTRACT

A method and apparatus for use with a grooved perfecting cylinder in a sheet-fed rotary printing press of the type capable of one sided or two sided sheet printing, the apparatus including a substantially rigid covering having a friction reducing coating thereon and which can be quickly and easily installed and removed over the sheet supporting surface of the perfecting cylinder when the press is operated in the one sided printing mode to permit an anti-marking fabric net to be installed and used over the sheet supporting surface of the perfecting cylinder.

28 Claims, 3 Drawing Sheets

FIG. 1
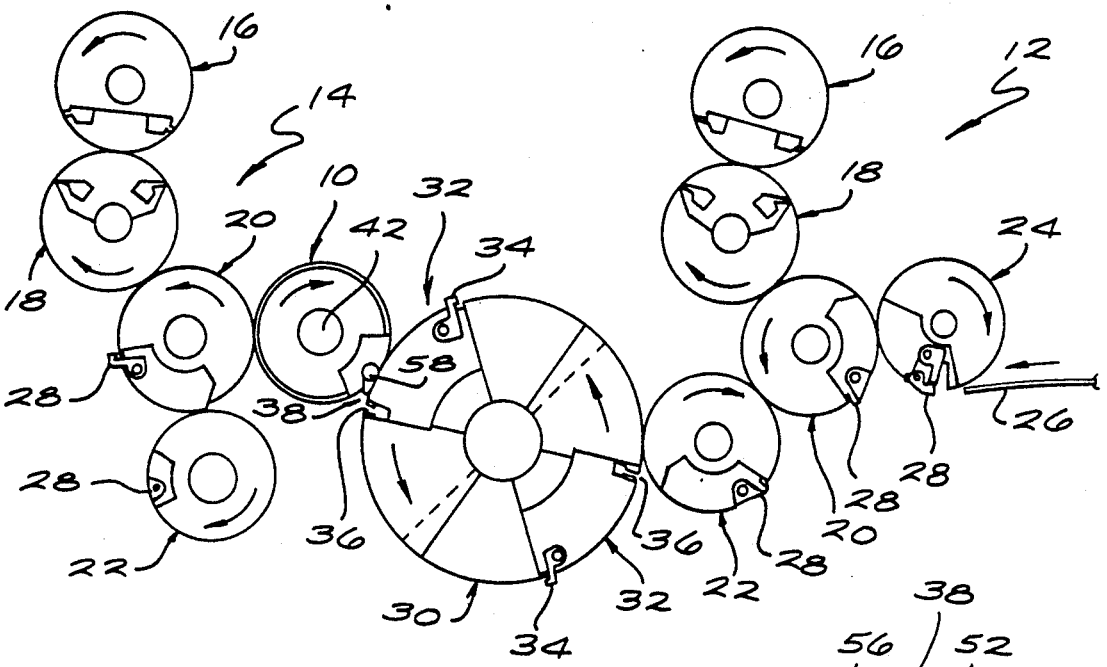
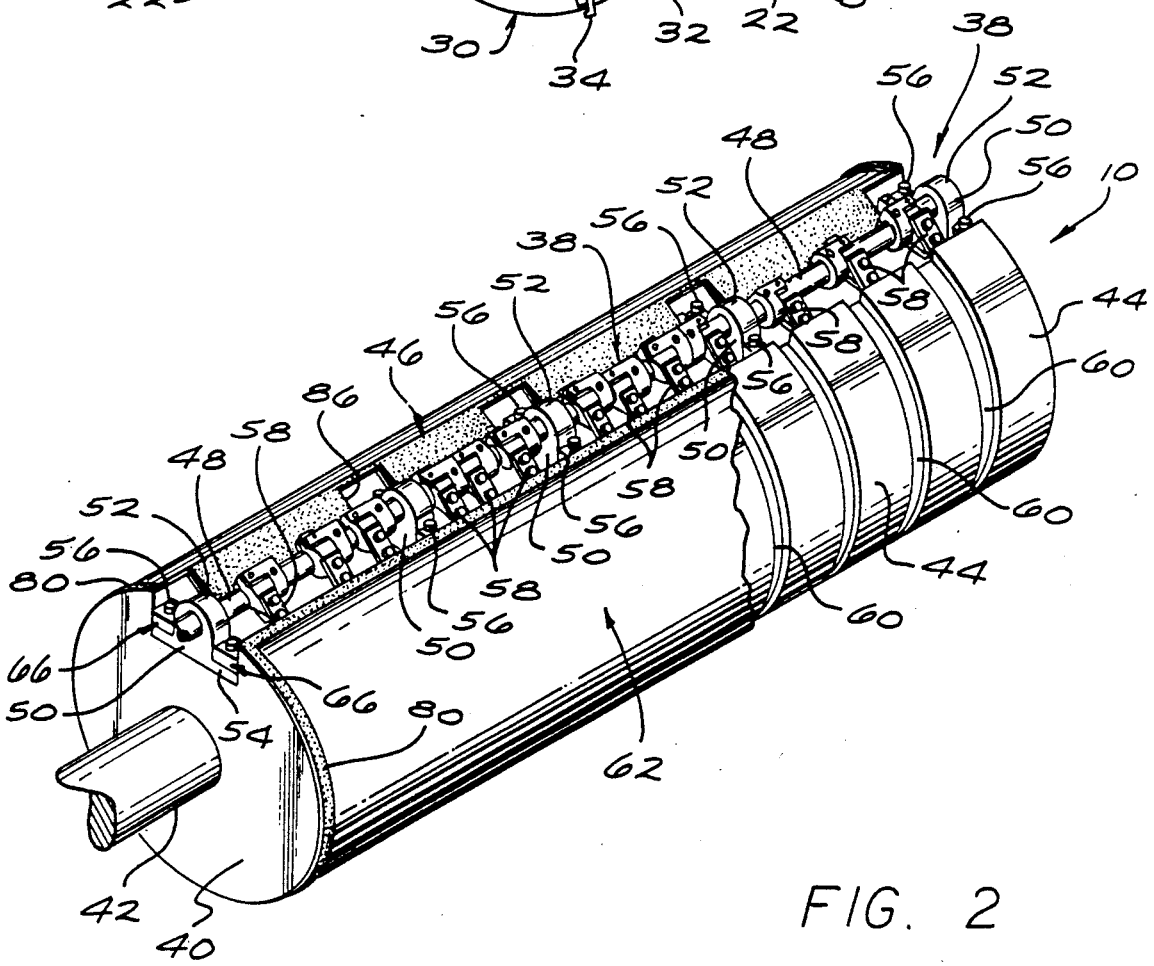
FIG. 2

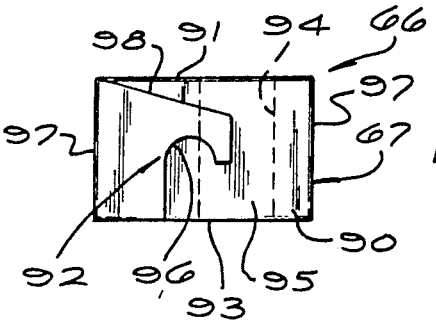
FIG. 7
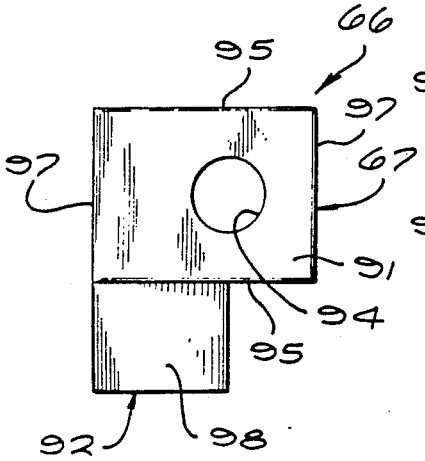
FIG. 8
FIG. 9
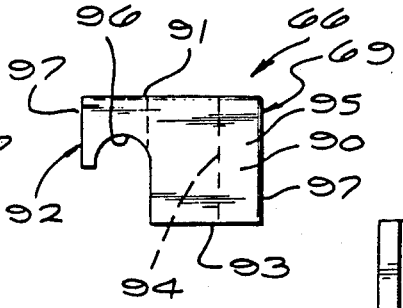
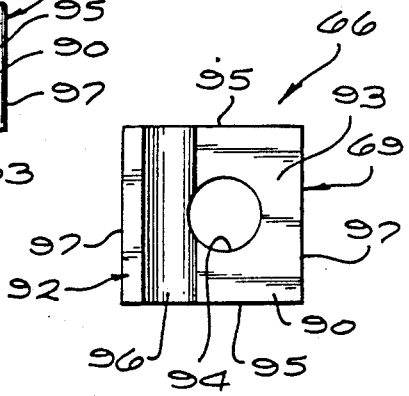
FIG. 10
FIG. 11
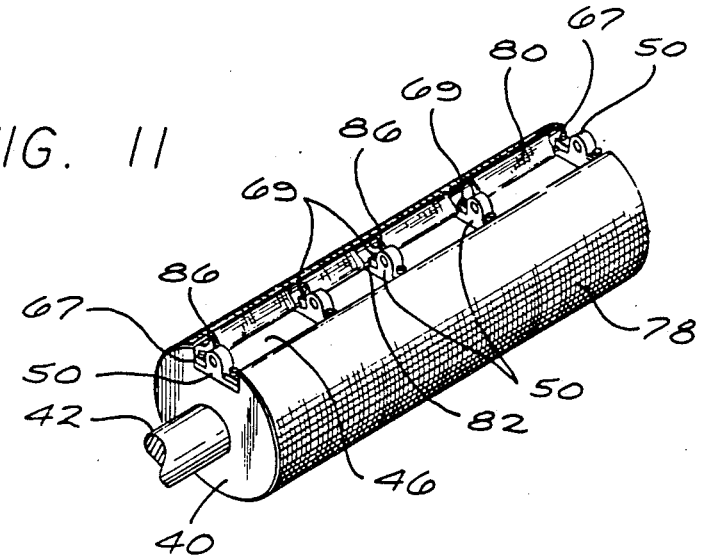

ANTI-MARKING METHOD AND APPARATUS FOR USE WITH PERFECTOR CYLINDERS OF ROTARY SHEET-FED PRINTING PRESSES

BACKGROUND OF THE INVENTION

This invention relates to printing presses, and more particularly, to an anti-marking method and apparatus for preventing the marking and marring of printed sheets in a high speed, sheet-fed multicolor rotary printing press of the type having a perfecting cylinder for permitting either one sided or two sided printing.

Many high speed, sheet-fed rotary printing presses are provided with perfecting cylinders which permit the press to print on two sides of a sheet, and which can also be used for single sided, multi-color printing. Examples of such presses are those currently manufactured by Heidelberger Druckmaschinen AG, of Heidelberg, West Germany under its designations "Speedmaster", "M-Offset" and "GTO". In such presses, a perfecting cylinder is used to transfer sheets which have been printed on one side in a first printing station, from a storage drum to a second printing station for further printing. The perfecting cylinder is adjustably timed with respect to the storage drum such that the perfecting cylinder either transfers the sheet, leading edge first, to the second printing station where a second color ink is applied to the same side previously printed (referred to as one sided or non-perfector mode printing), or the sheet is reversed and transferred to the second printing station trailing or tail edge first for printing on the reverse side (referred to as perfector mode printing).

When used in the perfector mode for two sided printing, sheet grippers carried by the perfecting cylinder which project radially from a longitudinal opening formed along the length of the cylinder, are timed to grip the tail edge of the sheet from the storage drum after the leading edge of the sheet on the storage drum has passed through the nip between the perfecting cylinder and the storage drum, and to pull the sheet from the storage drum with the non-printed side supported by the surface of the perfecting cylinder. When used in the non-perfector mode, the leading edge of the sheet is gripped by the grippers of the perfecting cylinder at the nip, and pulled from the storage drum with the wet inked side facing and supported by the surface of the perfecting cylinder.

The storage drum typically is sized to have a diameter twice that of the perfecting cylinder, and carries two sets of diametrically opposed sheet gripper mechanisms, each set comprising sheet grippers for the leading edge of the sheet and sheet grippers for the tail edge of the sheet. Since the perfecting cylinder must allow the leading edge of the sheet carried by the storage drum to pass through the nip when the press is used in the perfector mode, the supporting surface of the perfecting cylinder is provided with a series of longitudinally spaced circumferential channels or grooves which allow the leading edge sheet grippers of the storage drum to pass through the nip. When the press is used in the non-perfector mode, however, since the leading edge of the sheet is transferred to the perfecting cylinder at the nip, grooves in the supporting surface of the perfecting cylinder are not required since the leading edge grippers of the storage drum essentially mate with the opening in the perfecting cylinder from which its sheet grippers project.

During perfector mode printing, the perfecting cylinder operates to reverse the sheet so that the non-inked side of the sheet is carried by the supporting surface of the perfecting cylinder, and marking and marring of the freshly printed sheet can not occur. However, marking and marring of the freshly printed sheet has been found to occur when the press is used in the non-perfector mode since the perfecting cylinder merely acts as a conventional press transfer cylinder with the printed side of the sheet carried against the supporting surface of the perfecting cylinder during the transfer and the grooved surface does not provide uniform sheet support.

It is now well recognized and accepted in the printing industry that marking and marring of freshly printed sheets caused by engagement of the wet inked surface with the supporting surface of a conventional press transfer cylinder can be substantially eliminated by using an anti-marking net system such as disclosed in the DeMoore U.S. Pat. No. 4,402,267 issued Sept. 6, 1983 and entitled "Method and Apparatus for Handling Printed Sheet Material", the disclosure of which is incorporated herein by this reference. That system, which is marketed under license by Printing Research, Inc. of Dallas, TX under the registered trademark "Super Blue", includes the use of a low friction coating on the supporting surface of the transfer cylinder, and over which is loosely disposed a fabric cover referred to in the trade as a "net". It is believed that the loosely mounted net attaches and clings to the wet inked side of the freshly printed sheet as the sheet is supported by the transfer cylinder such that any relative motion between the sheet and the cylinder takes place between the surface of the net and the low friction coated surface of the cylinder so that marking and marring of the freshly printed surface does not occur.

While attempts have heretofore been made to adapt the anti-marking system disclosed in the DeMoore Pat. No. 4,402,267 for perfecting cylinders, prior to the present invention none had proved satisfactory. One such attempt has been to simply mount a net over the grooved supporting surface of the perfecting cylinder when ever the press is to be used in the non-perfector mode. This approach, however, has not proved satisfactory since the grooved surface of the cylinder does not provide a smooth, uniform support surface for the sheet, and it has been found that marking and marring of the sheet in the area of the unsupported portions of the net overlying the grooves may occur. Another suggestion has been to replace the perfecting cylinder with a smooth surfaced cylinder such as a conventional transfer cylinder, but that approach is impractical and destroys the purpose of the perfecting cylinder since the press can not then be used in the perfector mode.

Thus, there exists a need for an effective and reliable method and apparatus to prevent freshly printed sheets from being marked and marred by the grooved supporting surface of the perfecting cylinder when the press is operated in the non-perfector mode, yet which is relatively simple in design, inexpensive to manufacture and can be quickly and easily installed or removed from the press with a minimum of lost press production time during conversion between perfector and non-perfector modes. As will become apparent from the following, the present invention satisfies this need in a novel and unobvious manner.

SUMMARY OF THE INVENTION

The method and apparatus of the present invention prevents marking and marring of the freshly printed sheets during use of a press in the non-perfector mode of operation by removably mounting a smooth, substantially rigid, low friction coated covering over the grooved support surface of the perfecting cylinder, and to which an anti-marking net can be attached. To permit the covering to be quickly, simply and easily applied over or removed from the perfecting cylinder, mounting means are provided which clamp the covering directly to the existing pillow blocks supporting the gripper mechanism of the perfecting cylinder so that no boring or other modifications are required to be made to the perfecting cylinder or its gripper mechanism.

The covering is formed as a generally C-shaped member having lateral and longitudinal side edges dimensioned to overlie the supporting surface of the perfecting cylinder, and the coating, which preferably is polytetrafluoroethylene, is formed on the radially outer face of the covering facing the sheet. The mounting means comprise specially designed retainer clips which include hook portions for releasably engaging elongated rods attached to the longitudinal side edges of the covering to clamp the covering in position over the perfecting cylinder. Preferably, the covering is formed as a laminate with a base portion made from a generally rigid plastic material such as polystyrene, and a tightly woven fabric web to one side of which is bonded the friction reducing coating. A fastening strip, preferably VELCRO, is secured over the coating along the lateral and longitudinal side edges of the covering, and functions to permit the anti-marking net to be removably attached to the covering.

The retainer clips are attached to the pillow blocks, and can be mounted using the existing pillow block mounting bolts so that no press or gripper mechanism modifications are required. Moreover, the retainer clips can remain permanently installed on the perfecting cylinder so that they remain in place even while the press is operated in the perfector mode. This permits the conversion between perfector and non-perfector operations to be accomplished with a minimum of lost press production time, as all that is required is that the rods of the covering be snapped into or out of the retainer clips.

These and other features and advantages of the present invention will become more apparent from the following detailed description taken in conjunction with the accompanying drawings, which illustrate, by way of example, the principles of the invention.

BRIEF DESCRIPTION OF THE DRAWINGS

FIG. 1 is a schematic illustration of a portion of a sheet fed, multicolor rotary printing press having a perfecting cylinder of the type with which the present invention is intended to be used;

FIG. 2 is an enlarged perspective view, with portions cut-away to show underlying features, of a perfecting cylinder having a covering in accordance with the present invention installed thereon;

FIG. 7 is an enlarged side elevation view of an end mounting clip shown in FIG. 5;

FIG. 8 is an enlarged top plan view of an end mounting clip shown in FIG. 5;

FIG. 9 is an enlarged side elevation view of a center mounting clip shown in FIG. 6;

FIG. 10 is an enlarged bottom plan view of a center mounting clip shown in FIG. 6; and FIG. 11 is a perspective view of a perfecting cylinder having the covering of the present invention installed thereon and covered by an anti-marking fabric net, and shown removed from the press and without the gripper mechanism mounted thereto.

DETAILED DESCRIPTION OF PREFERRED EMBODIMENT

Figure 3:
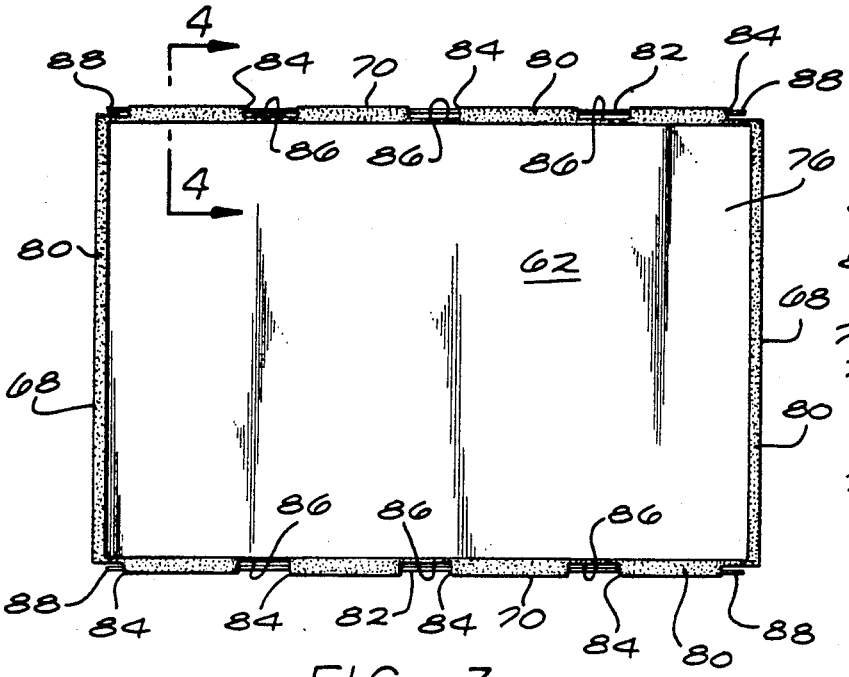
FIG. 3 is a top plan view of a covering constructed in accordance with the invention, and shown prior to installation onto the perfecting cylinder of a press.

The present invention is embodied in an anti-marking apparatus and method for use with a perfecting cylinder 10 in a multicolor sheet-fed, high speed rotary off-set printing press of the type capable of printing individual sheets on either one or both sides. As is well understood by those familiar with rotary printing presses equipped with perfecting cylinders 10, the function of the perfecting cylinder is to receive a sheet which has been printed on one side and either turn the sheet over for printing on the reverse side, hereinafter referred to as "perfector mode" printing, or to transfer the sheet for further printing on the same side, typically with a second color ink, and hereinafter referred to as "non-perfector mode" printing.

As shown in the schematic illustration of FIG. 1 of the exemplary drawings, the perfecting cylinder 10, sometimes referred to in the art as a reversing cylinder, is positioned in a press to receive a sheet which has been printed on one side in a conventional first printing station, herein generally designated by the reference numeral 12, and convey that sheet to a conventional second printing station, generally designated by the reference numeral 14. Herein, each printing station 12 and 14 includes a plate cylinder 16; a blanket cylinder 18; an impression cylinder 20; and a transfer cylinder 22, and the initial printing station 12 is provided with a sheet feed roller 24 which feeds individual sheets one at a time from a conventional feeder 26 to the initial impression cylinder for printing. Each of the impression cylinders 20, and transfer cylinders 22, as well as the sheet feed roller 24 is provided with a sheet gripper mechanism, generally designated 28, which grips the leading edge of the sheet to pull the sheet around the cylinder in the direction of the associated arrows shown. The function and operation of the cylinders and associated grippers of the printing stations 12 and 14 are believed to be well known to those familiar with multicolor sheet fed presses, and need not be described further except to note that the impression cylinders 20 function to press the sheets against the blanket cylinders 18 which apply ink to the sheets, and the transfer cylinders 22 convey the sheets away from the impression cylinders with the wet inked sides facing the support surfaces of the transfer cylinders. Preferably, since the transfer cylinders 22 support the printed sheet with the wet inked side facing the cylinder support surface, each transfer cylinder is provided with an anti-marking net system such as that described in before mentioned DeMoore U.S. Pat. No. 4,402,267 and marketed by Printing Research, Inc., of Dallas, TX under the registered trademark "Super Blue".

The perfecting cylinder 10 receives printed sheets from a storage drum 30 which, in turn, receives sheets printed on one side from the transfer cylinder 22 of the initial printing station 12. The storage drum 30, which is of conventional design, typically has a diameter twice that of the transfer cylinders 22, impression cylinders 20 and the perfecting cylinder 10, and is provided with two sets of diametrically opposed gripper mechanisms, herein generally designated by reference numeral 32. Each set of gripper mechanisms 32 includes leading edge grippers 34 for gripping the leading edge of the sheet from the transfer cylinder 22 of the initial printing station 12, and trailing or tail edge grippers 36 for gripping the trailing or tail edge of the sheet received from the transfer cylinder. Depending upon the printing mode in use, the perfecting cylinder 10, which has a single gripper mechanism 38, receives the sheets from the storage drum 30 by gripping either the tail edge of the sheet or the leading edge of the sheet.

The perfecting cylinder 10, best seen in FIG. 2, is of conventional design, and comprises a generally cylindrical body 40 supported on a drive shaft 42 mounted for rotation within the press, and defines an outer support surface 44. An elongated channel or opening 46 is formed along the axial length of the support surface 44 and within which the gripper mechanism 38 is mounted. Herein, the gripper mechanism 38 includes an operating shaft 48 supported for rotation by pillow blocks 50 longitudinally spaced along the length of the opening 46, the pillow blocks having upstanding bored central portions 52 through which the operating shaft 48 is journaled, and flanged bases 54 herein secured to the cylinder by bolts 56 extending into the body 40 of the perfecting cylinder 10 at the base of the opening. The operating shaft 48 supports a series of longitudinally spaced grippers 58 which project radially outwardly of the support surface 44 for gripping the sheets from the storage drum 30, the grippers being operated in the conventional manner to open and close at the appropriate time for gripping and releasing the printed sheet. Conventional means (not shown) are also provided for permitting the grippers 58 to be rotated approximately 180 degrees about the axis of the shaft 48 for orienting the grippers for gripping the sheet tail or leading edge, depending upon the mode of press operation being used. In the perfector mode of operation, the timing of the storage drum 30 and the perfecting cylinder 10 is selected such that the gripper mechanism 38 of the perfecting cylinder will grip the tail edge of the sheet to pull the sheet tail edge first from the storage drum so that the unprinted side of the sheet is facing the support surface 44 of the perfecting cylinder. In the non-perfector mode of operation, the timing is selected such that the gripper mechanism 38 of the perfecting cylinder 10 will grip the leading edge of the sheet on the storage drum 30 so that the printed side of the sheet is facing the support surface 44 of the perfecting cylinder. During perfector mode printing, the leading edge grippers 34 of the storage drum 30 must be permitted to pass through the nip of the storage drum and perfecting cylinder 10 so that the grippers 38 of the perfecting cylinder can grip the trailing edge of the sheet.

In order to provide clearance for the passage of the leading edge grippers 34 of the storage drum 30 past the support surface 44 of the perfecting cylinder 10, longitudinally spaced circumferential grooves or channels 60 are required to be formed in the support surface of the perfecting cylinder, as best can be seen in the broken away portion of FIG. 2. In the single sided, non-perfector mode of printing, however, since the grippers 38 of the perfecting cylinder 10 grip the sheet at the leading edge, the leading edge grippers 34 of the storage drum 30 can pass freely through the nip since the leading edge grippers are aligned with the longitudinal opening 46 of the perfecting cylinder through which its grippers project. Thus, in the non-perfector mode of operation, no circumferential grooves or channels are needed in the support surface 44 of the perfecting cylinder 10 for permitting the leading edge grippers 34 of the storage drum 30 to pass through the nip.

During use of the press in the non-perfector mode of printing, since the wet inked side of the printed sheet is in contact with the support surface 44 of the perfecting cylinder 10, it has been found that marking and marring of the freshly printed sheet may occur. In accordance with the anti-marking method and apparatus of the present invention, marking and marring of the freshly printed sheets during use of the press in the non-perfector mode of operation is prevented by removably mounting a smooth, relatively rigid, low friction covering, generally designated by reference numeral 62 in FIG. 2, over the grooved support surface 44 of the perfecting cylinder 10. This covering 62 provides a uniform, slick surface for supporting the printed sheet over its entire area, and permits the perfecting cylinder 10 to be provided with an anti-marking fabric net of the general type described in the aforementioned DeMoore Pat. No. 4,402,267 when the press is in the non-perfector mode, yet which can be quickly and easily removed with a minimum of lost press production time for converting the press to perfector mode operation. To permit the covering 62 to be quickly, simply and easily applied or removed from the perfecting cylinder 10, mounting means, herein comprising specially shaped retainer clips generally designated by reference numeral 66, are provided which clamp the covering directly to the existing pillow blocks 50 supporting the gripper mechanism 38 of the perfecting cylinder so that no boring or other modifications are required to be made to the perfecting cylinder or its gripper mechanism.

Toward the foregoing ends, as best seen in FIG. 3 which depicts the covering 62 prior to mounting on the perfecting cylinder 10, the covering has a generally rectangular shape and is sized to extend over and fully cover the grooved support surface 44 of the perfecting cylinder. That is, the covering 62 is formed to have lateral side edges 68 spaced apart a distance substantially equal to the axial length of the perfecting cylinder 10, and spaced longitudinal sides 70 forming a covering width sufficient to permit the covering to extend circumferentially around the support surface 44 from one side of the opening 46 to the other. Preferably, the covering 62 is formed from a bendable yet substantially rigid material, and is supplied on one side with a coating of low friction material.

Figure 4:
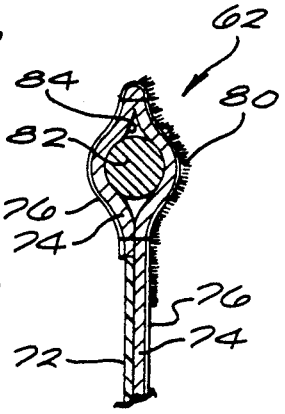
FIG. 4 is an enlarged sectional view taken substantially along the line 4—4 of FIG. 3.

Herein, as shown in FIG. 4, the covering 62 is formed as a three part composite laminate, with an inner base portion 72, seen at the left, formed of a bendable yet generally rigid plastic material such as polystyrene or the like having a thickness on the order of 0.020 inches (0.51 mm); a center portion 74 formed from a flexible substrate, preferably a fabric-type web material such as a very tightly woven cotton or canvas, having a thickness on the order of 0.019 inches (0.48 mm); and an outer face coating 76 formed of a low friction material such as polytetrafluoroethylene or other suitable material which will provide a smooth, slick and effectively friction free surface, and preferably having a thickness on the order of 0.002 inches (0.05 mm). Initially, the covering 62 is formed by laminating the plastic base portion 72, fabric web 74, and coating 76 in the flat condition, and thereafter, the covering is rolled or bent so that the covering has a generally C-shaped configuration which will overlie the support surface 44 of the perfecting cylinder 10 with the coating forming the circumferentially outer face. Preferably, the low friction coating 76 is separately formed on the fabric web 74 as a bonded coating which, thereafter is sewn or otherwise laminated to the plastic base portion 72.

To permit a fabric net 78 (see FIG. 11), which typically is formed from a loose weave material such as cheesecloth and impregnated with a liquid and ink repellant substance, as described in the DeMoore Pat. No. 4,402,267, to be attached to the covering 62, disposed about the entire periphery of the outer surface of the covering is a strip of fastening material 80, preferably made from VELCRO, which can be bonded, sewn, or otherwise secured to the composite covering over the coating 76. The VELCRO fastening strip 80 permits the anti-marking net 78 to be quickly and easily installed on or removed from the covering 62 when the covering is installed in the press, such as may be required in the event the net becomes torn or soiled after prolonged use.

Since the covering 62 of the present invention is needed only when the press is operated in the non-perfector mode, it is important that the covering be readily removed and installed over the perfecting cylinder 10 with a minimum of lost press production time. That is, the covering 62 must be capable of being very quickly and easily attached to or removed from the perfecting cylinder 10 so that conversion from perfector to non-perfector press operation can be made with a minimum of press down time.

Toward this end, the covering 62 is provided with a pair of cylindrical mounting rods 82, preferably made of stainless steel, which extend along the longitudinal sides 70 through loops 84 formed by doubling the longitudinal sides of the fabric material 74 onto itself and sewing or otherwise securing the ends to form the loops. A series of cut-out openings 86 are formed at spaced locations along the loops 84 through which the rods are exposed, and the longitudinal ends of the loops are similarly cut-out to expose the end portions 88 of the rod, the length of the rod being slightly less that the longitudinal length of the covering 62 between the lateral sides 68.

To retain the covering 62, the rods 82 are secured to the perfecting cylinder 10 by attaching the exposed portions of the rods at the cut-outs 86 to the retainer clips 66. Herein, each of the retainer clips 66 is formed as a generally rectangular shaped metal block 90, preferably made by casting, having, respectively, generally flat upper and lower sides 91 and 93, sidewalls 95, and end walls 97, and is provided with a hook portion, generally designated 92, formed to receive the metal rod 82 to clamp the covering 62 in position over the grooved support surface 44 of the perfecting cylinder 10. The retainer clips 66 are permanently installed on the pillow blocks 50 of the perfecting cylinder 10 by removing the existing pillow block mounting screws 56, and reinstalling the screws through holes 94 formed in the blocks, and when installed, do not interfere with the normal operation of the gripper mechanism 38 or the perfecting cylinder, whether the press is operated in the perfector mode or in the non-perfector mode.

Figure 5:
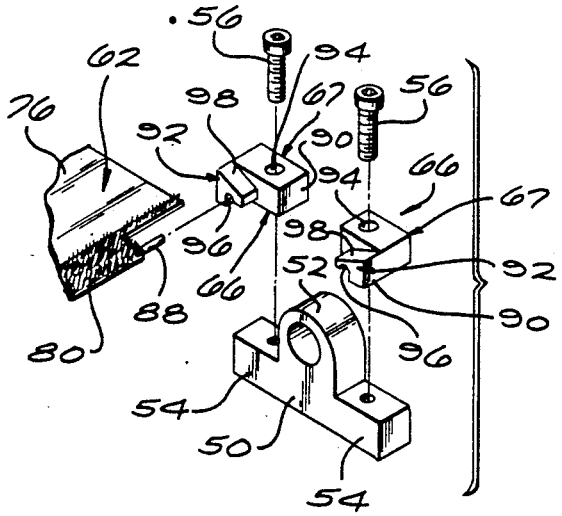
FIG. 5 is a fragmentary exploded perspective view showing the manner of assembly of the covering and end mounting clips of the invention to the perfecting cylinder of FIG. 2.
Figure 6:
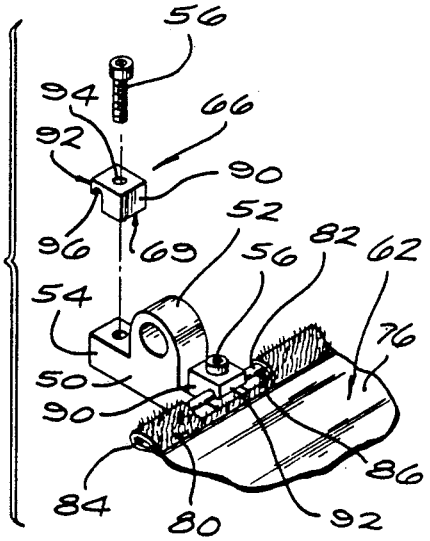
FIG. 6 is a fragmentary exploded perspective view showing the assembly of the covering and associated center mounting clips of the invention to the perfecting cylinder of FIG. 2.

The retainer clips 66 are constructed to form either end clips, generally designated 67 and shown in FIGS. 5, 7 and 8, or center clips, generally designated 69 and shown in FIGS. 6, 9 and 10, the hook portions 92 of each being formed with generally semi-circular recesses 96 having a diameter sufficient to receive the rods 82, and are mounted to the pillow blocks 50 with the recesses opening downwardly relative to the upstanding central portions 52 of the pillow blocks. As seen in FIGS. 5, 7 and 8, the end clips 67 are attached to the pillow blocks 50 with the hook portions 92 projecting inwardly toward the upstanding central portions 52 of the pillow blocks, and the hook portions are formed as lateral extensions projecting from one sidewall 95 of the block 90, axially oppositely facing end clips when mounted on the perfecting cylinder 10 having the hook portions projecting towards each other. With this arrangement, the axial end portions 88 of the mounting rods 82 received in the recesses 96 of the hook portions 92 of the end clips 67 will abut the sidewalls 95 of the blocks 90 to prevent the rods from sliding axially along the perfecting cylinder 10 relative to the loops 84.

Each of the center clips 69 shown in FIGS. 6, 9 and 10, is made to have its recesses 96 formed as an unobstructed semi-circular channel extending along one of the longitudinal sides of the block 90, and is attached to the pillow- block 50 with the hook portion projecting away from the upstanding central portion 52 of the pillow block. With this arrangement, the covering 62 can be quickly and easily installed by first clipping the exposed portions of the mounting rods 82 into the hook portions 92 of the center clips 69, and then snapping the end portions 88 of the rod into the hook portions of the end clips 67.

Typically, the rods 82 are inserted into and removed from the mounting clips 66 by using a screw driver or other suitable tool to effectively lever the rod around the ends of the hook portions 92 so that when the rods are fully seated in the semi-circular recesses 96, the covering 62 is stretched taught over the grooved support surface 44 of the perfecting cylinder 10. To facilitate the mounting of the end portions 88 of the rods 82 into the end clips 67, the upwardly facing surfaces 98 of the hook portions 92 are formed as inclined ramps sloping toward the underlying recesses 96 and over which the rods can be slid around the ends of the hook portions into the recesses. Thus, to either install or remove the covering 62 from the perfecting cylinder 10, all that need be done is to snap the mounting rods 82 in to or out of the mounting clips 66, and no fasteners or other devices are required to be used or manipulated, thereby making installation and removal extremely easy and quick.

Once the covering 62 has been installed on the perfecting cylinder 10, the anti-marking net 78 can be quickly and simply attached to the covering by pressing the side edges of the net onto the VELCRO fastener strip 80. Once the net 78 has been installed, the press can be operated in the non-perfector mode, and marking and marring of the printed sheets will not occur since the laminate structure of the covering 62 provides a smooth, substantially rigid surface which supports the printed sheets evenly whereby the sheets can uniformly attach and cling to the net so that any relative motion between the perfecting cylinder 10 and the sheet will take place between the net and the frictionless outer surface 76 of the covering. When it is desired to operate the press in the perfector mode, all that need be done is to remove the covering 62 from the mounting clips 66 to again expose the grooves 60 in the support surface 44 of the perfecting cylinder 10.

From the foregoing, it should be appreciated that the method and apparatus of the invention provides a reliable and effective way to convert a perfecting cylinder 10 to permit use of an anti-marking net system of the type disclosed in the aforementioned DeMoore Patent when the press is used in the non-perfector mode, and which permits the conversion between non-perfector and perfector modes of operation to be done in an easy and rapid manner so as to minimize lost press production time. Moreover, the method and apparatus of the invention permits the conversion to be done without press modification or complex assembly, and employs parts which are relatively simple and inexpensive to manufacture. While a particular form of the invention has been illustrated and described herein, it will be readily apparent to those skilled in the art that various modifications and variations may be made without departing from the spirit and scope of the invention as defined by the appended claims.

I claim:

1. In a sheet-fed, rotary printing press of the type having a perfecting cylinder for permitting the press to be operated for one sided or two sided sheet printing, the perfecting cylinder having a generally cylindrical support surface with longitudinally spaced circumferential grooves formed axially therealong and adapted to support the non-inked side of a printed sheet when said press is operated in the two sided printing mode and to support the wet inked side of a printed sheet when said press is operated in the one sided printing mode, the improvement for use when said press is operated in the one sided printing mode comprising:

a substantially rigid, generally C-shaped covering having spaced lateral and longitudinal side edges dimensioned to overlie said sheet support surface of said perfecting cylinder, and having a substantially smooth, friction reducing coating on one face thereof;

means for releasably mounting said covering over said sheet support surface of said perfecting cylinder with said coating facing radially outwardly toward said sheet, whereby, when said press is operated in said one sided printing mode, said wet inked side of said printed sheet is evenly supported by said substantially rigid covering.

2. The improvement as set forth in claim 1 wherein said means for mounting comprise retainer clips permanently attached to said perfecting cylinder, and said covering is releasably attached over said support surface by said clips.

3. The improvement as set forth in claim 1 wherein an anti-marking fabric net is removably attached to said covering over said coating.

4. The improvement as set forth in claim 1 wherein said covering is formed from a generally rigid plastic material.

5. The improvement as set forth in claim 4 wherein said coating is formed on a substrate laminated to said one face of said covering.

6. The improvement as set forth in claim 5 wherein said coating is polytetrafluoroethylene bonded to said substrate.

7. The improvement as set forth in claim 2 wherein said covering includes axially extending rods attached to said longitudinal side edges, and said retainer clips include hook portions releasably engaging said rods.

8. The improvement as set forth in claim 7 wherein an anti-marking fabric net is removably attached to said covering over said coating.

9. The improvement as set forth in claim 8 wherein said covering is formed from a generally rigid plastic material.

10. The improvement as set forth in claim 9 wherein said coating is polytetrafluoroethylene.

11. The improvement as set forth in claim 10 wherein said coating is formed on a fabric web laminated to said one face of said plastic material.

12. The improvement as set forth in claim 11 wherein a fastening strip is secured to said covering over said coating along said lateral and longitudinal side edges.

13. For use in a sheet fed rotary printing press of the type having a perfecting cylinder for permitting the press to be operated for one sided or two sided sheet printing, the perfecting cylinder having a sheet supporting surface with longitudinally spaced circumferential grooves formed axially therealong and adapted to support the non-inked side of said sheet when said press is operated in the two sided printing mode and to support the wet inked side of said sheet when said press is operated in the one sided printing mode, and having an elongated axially extending channel formed in the supporting surface within which is mounted a sheet gripper mechanism supported by pillow blocks bolted to the perfecting cylinder within said channel, an apparatus for preventing marking and marring of printed sheets by said perfecting cylinder when said press is operated in said one sided printing mode comprising:

a generally C-shaped, substantially rigid covering having lateral and longitudinal side edges dimensioned to overlie said supporting surface of said perfecting cylinder, and having a friction reducing coating on the radially outer face thereof;

an anti-marking fabric net removably attached to said covering over said friction reducing coating; and means for releasably mounting said covering over said grooved sheet supporting surface with said anti-marking net facing said sheet, whereby, when said press is operated in said one sided printing mode, said wet inked side of said printed sheet is engaged with said net and supported on said substantially rigid covering.

14. An apparatus as set forth in claim 13 wherein said means for mounting comprise retainer clips permanently attached by said bolts to said pillow blocks, and said covering is releasably coupled to said clips.

15. An apparatus as set forth in claim 14 wherein said covering is formed from a generally rigid plastic material.

16. An apparatus as set forth in claim 15 wherein said coating is polytetrafluoroethylene.

17. An apparatus as set forth in claim 13 wherein said covering is formed of a generally rigid plastic sheet material and said coating is formed on a substrate laminated to one side of said plastic sheet.

18. An apparatus as set forth in claim 17 wherein said plastic sheet material is polystyrene.

19. An apparatus as set forth in claim 18 wherein said coating is formed from polytetrafluoroethylene bonded to said substrate.

20. An apparatus as set forth in claim 19 wherein said net is attached to said covering by a fastening strip secured over said coating around said lateral and longitudinal side edges.

21. A covering for use with a perfecting cylinder in a sheet-fed, rotary printing press of the type capable of printing sheets on either one or both sides, the perfecting cylinder having a grooved supporting surface for supporting the non-inked side of the printed sheet when the press is operated in the perfector mode for two sided printing, and supporting the wet inked side of the sheet when the press is operated in the non-perfector mode for one sided printing, said covering comprising:

a substantially rigid C-shaped base formed of a generally rigid plastic material, and having lateral and longitudinal side edges dimensioned to overlie said grooved supporting surface of said perfecting cylinder;

a friction reducing coating formed on the radially outer face of said C-shaped base; and means coupled to said base for releasably attaching said base to said perfecting cylinder over said grooved supporting surface.

22. A covering as set forth in claim 21 wherein said means for releasably attaching said base include elongated rods coupled to said longitudinal side edges.

23. A covering as set forth in claim 21 wherein said plastic material is polystyrene.

24. A covering as set forth in claim 21 wherein said coating is formed on a substrate laminated over said base.

25. A covering as set forth in claim 24 wherein said coating is polytetrafluoroethylene.

26. A covering as set forth in claim 25 wherein said plastic material is polystyrene.

27. A method for preventing marking and marring of the wet ink side of a printed sheet during passage of the sheet over the grooved sheet supporting surface of a perfecting cylinder in a sheet fed rotary printing press of the type capable of being used for one sided or two sided sheet printing when the press is operated in the one sided printing mode, comprising the steps of:

providing a substantially rigid covering dimensioned to overlie the supporting surface of the perfecting cylinder, and having a friction reducing coating on one face thereof;

positioning said covering over the grooved supporting surface of the perfecting cylinder with said friction reducing coating facing the sheet; and removably attaching said covering to the perfecting cylinder so as to substantially completely cover the grooved supporting surface.

28. The method as set forth in claim 27 further including the step of releasably securing an anti-marking fabric net to said covering over said friction reducing coating.

* * * * *